US008764590B2

(12) United States Patent
Draper

(10) Patent No.: US 8,764,590 B2
(45) Date of Patent: Jul. 1, 2014

(54) LIGHT EMITTING ARCHERY DEVICE

(76) Inventor: Chad Draper, Wadsworth, NY (US)

( * ) Notice: Subject to any disclaimer, the term of this patent is extended or adjusted under 35 U.S.C. 154(b) by 0 days.

(21) Appl. No.: 13/555,391

(22) Filed: Jul. 23, 2012

(65) Prior Publication Data

US 2013/0023364 A1 Jan. 24, 2013

Related U.S. Application Data

(60) Provisional application No. 61/510,756, filed on Jul. 22, 2011.

(51) Int. Cl.
*F42B 6/04* (2006.01)

(52) U.S. Cl.
USPC ..... 473/578; 473/570

(58) Field of Classification Search
USPC ..... 473/570, 578
See application file for complete search history.

(56) References Cited

U.S. PATENT DOCUMENTS

| | | | | |
|---|---|---|---|---|
| 2,540,079 | A | 2/1951 | Ferguson | |
| 4,704,612 | A | 11/1987 | Boy | |
| 4,858,935 | A | 8/1989 | Capson | |
| 4,940,245 | A | 7/1990 | Bittle | |
| 5,094,463 | A | 3/1992 | Dryden | |
| 5,157,405 | A | 10/1992 | Wycoff | |
| 5,446,467 | A * | 8/1995 | Willett | 342/386 |
| 5,450,614 | A | 9/1995 | Rodriguez | |
| 6,390,642 | B1 | 5/2002 | Simonton | |
| 7,232,389 | B2 * | 6/2007 | Monteleone | 473/578 |
| 7,316,625 | B2 | 1/2008 | Takahashi | |
| 7,331,887 | B1 * | 2/2008 | Dunn | 473/578 |
| 7,837,580 | B2 * | 11/2010 | Huang et al. | 473/570 |
| 7,862,457 | B1 | 1/2011 | Urcheck | |
| 7,931,550 | B2 | 4/2011 | Lynch | |
| 8,446,282 | B1 * | 5/2013 | Warner et al. | 340/573.1 |
| 2007/0142137 | A1 * | 6/2007 | Davenhaver | 473/578 |
| 2010/0248871 | A1 | 9/2010 | Nick | |

* cited by examiner

*Primary Examiner* — John Ricci

(74) *Attorney, Agent, or Firm* — Hiscock & Barclay, LLP

(57) ABSTRACT

A device for illuminating the impact point of an arrow. The device contains at least one light source. Upon impact with a target, the device detaches from the arrow and attaches to the target to illuminate the impact point. When the target is live game, the illumination highlights the impact point and assists in tracking the game.

8 Claims, 5 Drawing Sheets

LIGHT EMITTING ARCHERY DEVICE

CROSS-REFERENCE TO RELATED APPLICATIONS

This application claims priority to and the benefit of U.S. provisional patent application Ser. No. 61/510,756, filed Jul. 22, 2011, which application is incorporated herein by reference in its entirety.

FIELD OF THE INVENTION

The invention relates to the field of archery, and more particularly to illuminated game taggers.

BACKGROUND

Many archers attempt to trace arrow flight from release to impact. However, tracing the arrow flight is difficult in low light conditions which are common at key hunting times (e.g. both dawn and dusk). The difficulty in tracing arrow flight further increases as arrow speed increases. Many bows are capable of projecting arrows at high speeds, making tracing the arrow flight much more difficult. There are numerous lighted nocks known in the art to help trace the arrow flight. However, lighted nocks generally add extra weight to the rear of the arrow, which can alter the flight characteristics of the arrow.

Additionally, lighted nocks only help in recovering the arrow. Most bows are capable of shooting an arrow completely through the game. Should the game run off after the arrow passes through, the lighted nock provides a mechanism to recover the arrow but is of no further assistance. An improved archery device is desired.

SUMMARY OF THE INVENTION

The invention comprises, in one form thereof, a device for illuminating an arrow that has minimum impact on arrow flight. The device has at least one light source, such an a light emitting diode (LED). In one embodiment the device detaches from the arrow and attaches to the game, illuminating the impact point of the arrow and allowing improved tracking of the game.

The device can further assist in tracking game in low light conditions. This is especially beneficial when a blood trail is lost.

BRIEF DESCRIPTION OF THE DRAWINGS

The present invention is disclosed with reference to the accompanying drawings, wherein.

Corresponding reference characters indicate corresponding parts throughout the several views. The examples set out herein illustrate several embodiments of the invention but should not be construed as limiting the scope of the invention in any manner.

DETAILED DESCRIPTION

The illumination device of the instant invention is a device that attaches to the front end of an arrow. By attaching the device in front of the center of gravity of the arrow, the arrow exhibits improved flight characteristics when compared to rear mounted devices. During arrow flight the device illuminates allowing the user to trace the arrow flight. In one embodiment, the device is equipped with an inertia switch that activates a light source when the arrow is deployed. Such an embodiment permits the arrow flight to be tracked. The light source remains activate until a user manually deactivates the light using a switch on the device. In another embodiment, the inertia switch activates upon impact with the target. This embodiment does not track arrow flight but functions as a game tagger.

Upon impact with a target, the device detaches from the arrow and attaches to the target. This illuminates the impact point and, when shooting live game, allows the user to track the game. In contrast, illuminated nocks only illuminate the tail of the arrow and fail to illuminate the impact point.

Figure 1A:
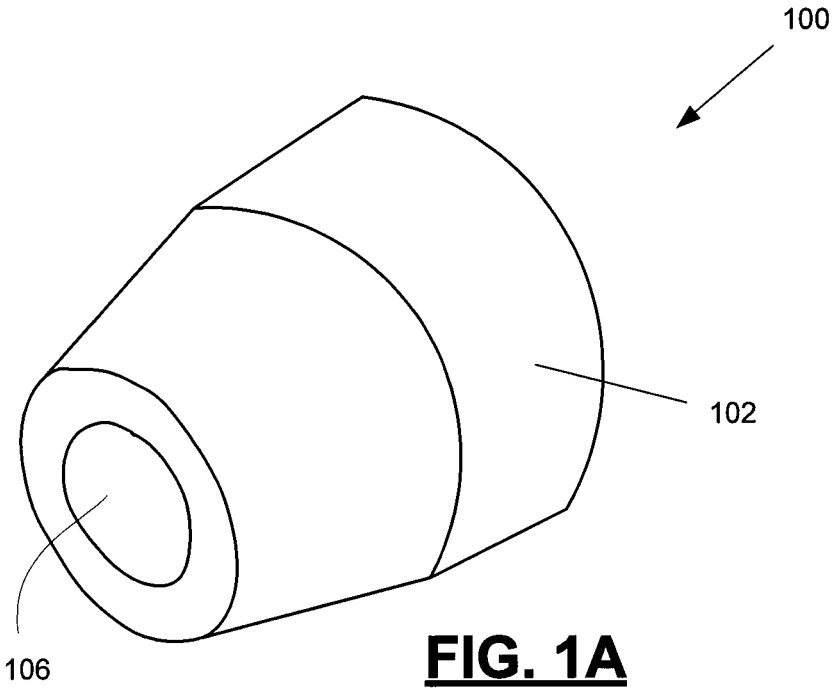
FIGS. 1A and 1B are two views of an illumination device according to one embodiment.
Figure 1B:
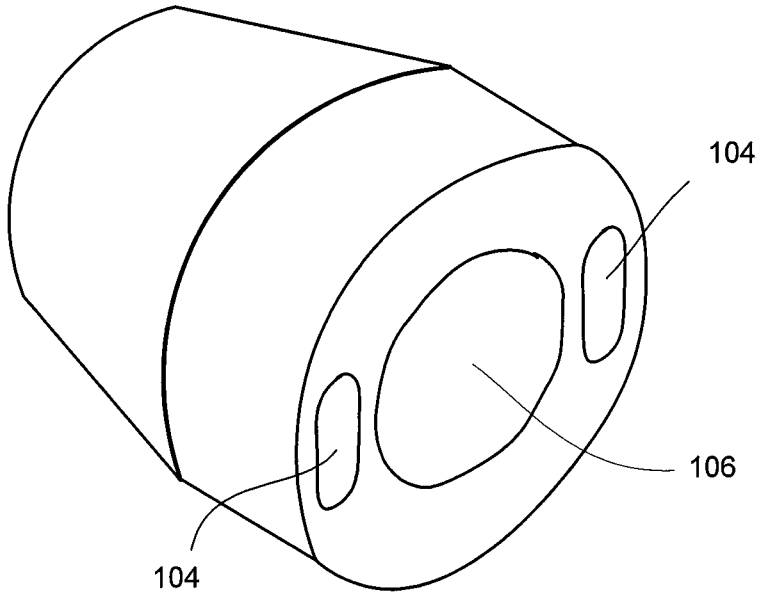

Referring to FIGS. 1A and 1B, there are shown views of an illumination device 100 according to one embodiment. The housing 102 contains all of the electronics to illuminate the device 100 including a power supply (not shown), such as a battery. In one embodiment, the power supply is a user-replaceable battery. In another embodiment, the power supply is internal to the housing 102. Housing 102 may be formed from a lightweight material such as a plastic or aluminum. The openings 104 contain a light emitting diode (LED) or other light source to allow the user to trace the arrow flight. It is understood that while the device is shown as having two openings, any number of openings may be used. Housing 102 has a hole 106 to permit attachment to a conventional arrow. As would be apparent to those skilled in the art, many conventional arrows have an arrowhead that is removably attached to a shaft. For example, the arrowhead may have a screw that mates with a threaded receptacle in the shaft. In other examples, the shaft has a screw that mates with a threaded receptacle in the arrowhead. The hole 106 is sized to permit the screw to pass through housing 102 before it mates with the threaded receptacle. In this fashion, the housing 102 may be attached to the front of a conventional arrow.

Figure 2:
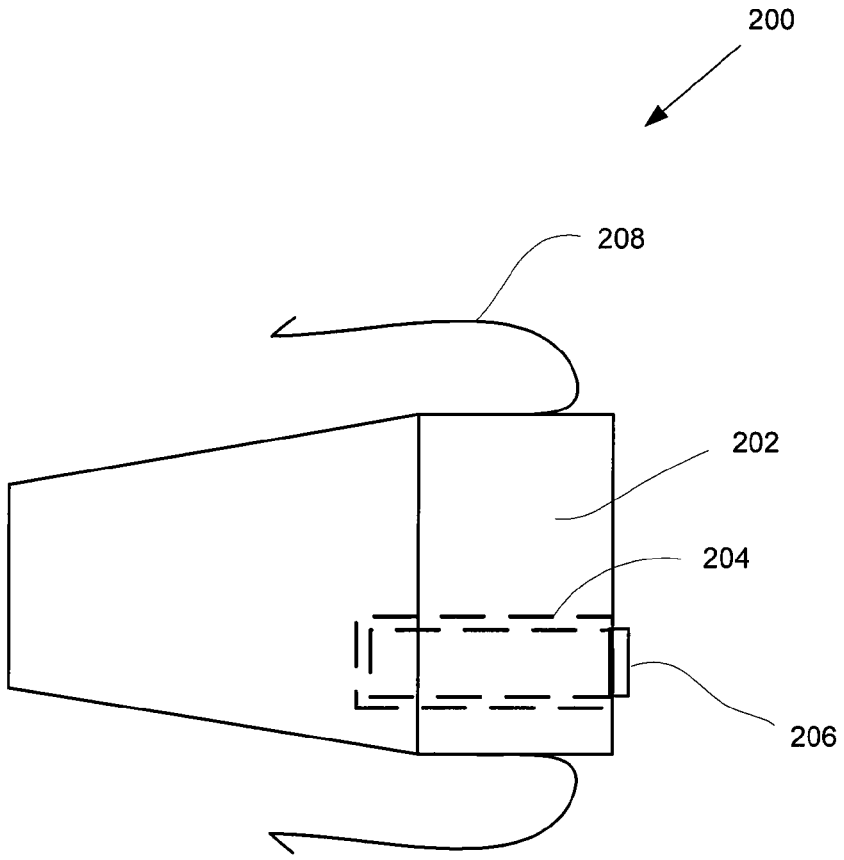
FIG. 2 is a view of a detachable illumination device having barbed fixtures according to one embodiment.

Referring now to FIG. 2, another illumination device 200 is shown according to another embodiment. Like housing 102, the housing 202 contains the electronics to illuminate the device 200. Light source 206 is located in opening 204 on the device 200 such that it can be viewed during arrow flight. In the embodiment of FIG. 2, fixtures 208 extend from the housing 202 and point in a forward direction toward the arrowhead (not shown). Fixtures 208 are configured to attach to the target as the arrow impacts, or passes completely through, the target. In one embodiment the barbed fixtures 208 are barbed hooks to better attach to a target. In the embodiment shown in FIGS. 3A and 3B, the housing is configured to detach from the arrow upon impact.

Figure 3A:
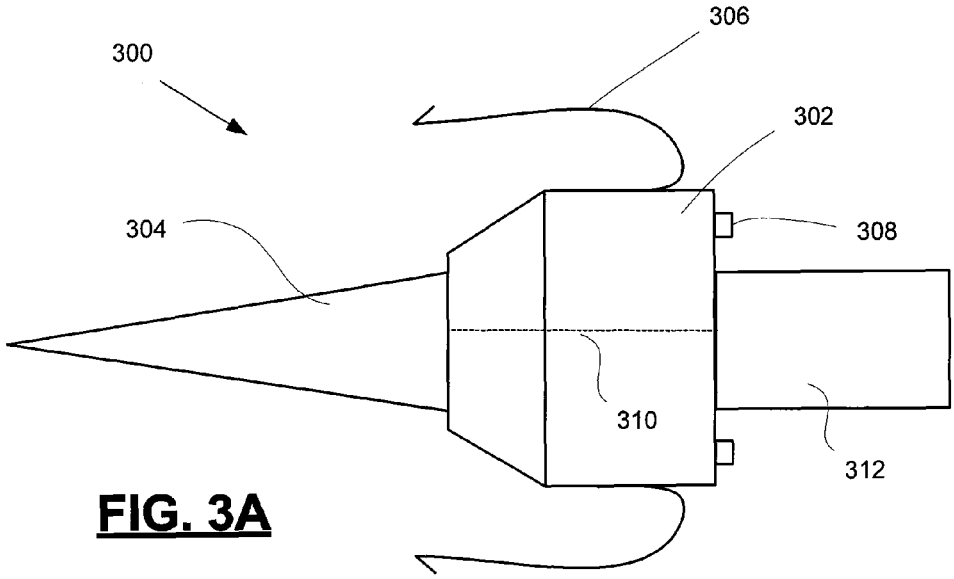
FIGS. 3A and 3B are two views of a detachable illumination device having fixtures according to one embodiment.
Figure 3B:
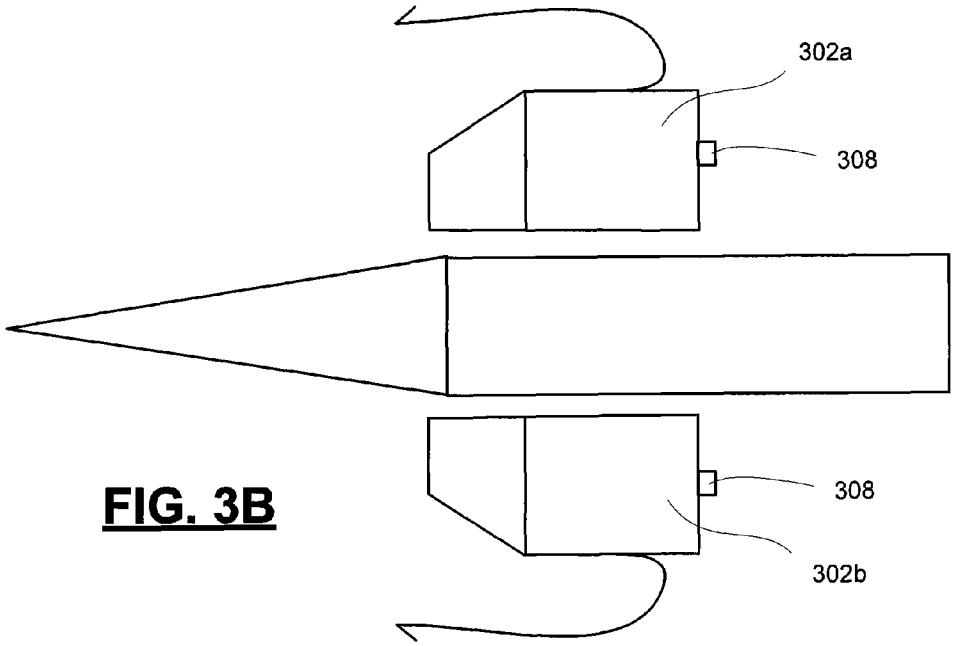

FIGS. 3A and 3B show two views of an illumination device 300 according to another embodiment. The housing 302 is attached to the front end of an arrow between an arrowhead 304 and its attached shaft 312. The housing 302 includes means for releasably attaching the housing 302 to the arrow. In the embodiment of FIGS. 3A and 3B, the means include pre-formed break-line 310 between segments 302*a* and 302*b*. Segments 302*a* and 302*b* are attached to one another by impact-sensitive attachments, such as snap connectors. Upon impact with the target, the barbed fixtures 306 attach to the target. Due to the force of the impact and associated shear stress between the moving arrow and the stationary target, the housing 302 releases along pre-formed break-line 310 thereby separating the housing 302 into segments 302*a* and 302*b*. This separates the housing 302 from the arrow. Since each segment has its own barbed fixture 306 and light source 308, each segments has its own opportunity to remain imbedded within the target and tag the target with light source 308. Upon recover of the target, the segments may be unified by snapping them together about the arrow to reconstruct housing 302.

Figure 4:
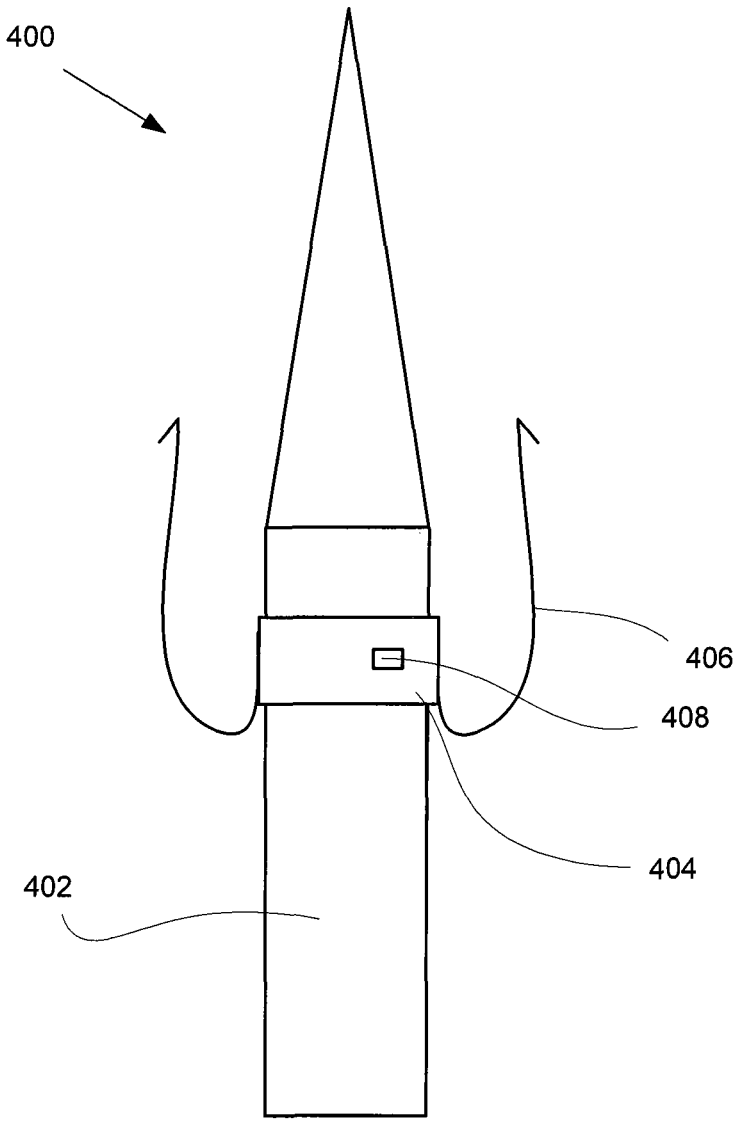
FIG. 4 is a view of a detachable illumination device having fixtures according to one embodiment.

Referring now to FIG. 4, there is shown an illumination device 400 according to another embodiment. The housing 404 includes means for releasably attaching the housing 404 to the arrow. In the embodiment of FIG. 4, the means include a sliding ring that is sized to traverse the length of the shaft. Upon impact, the barbed fixture 406 attaches to the target and the housing 404 slides along the arrow 402 as the arrow continues to move forward due to momentum. When the arrow 402 pass through the target, the arrow 402 separates from the housing 404 and remains attached to the target leaving light source 408 attached to the target.

In one embodiment, housing 404 is formed of a thin layer of plastic and is configured with a pre-formed break-line (not shown in FIG. 4 but see FIG. 3A) such as perforations in the plastic. For example, the thin layer of plastic may be a vinyl wrap such as a heat or moisture-sensitive shrink wrap.

Figure 5A:
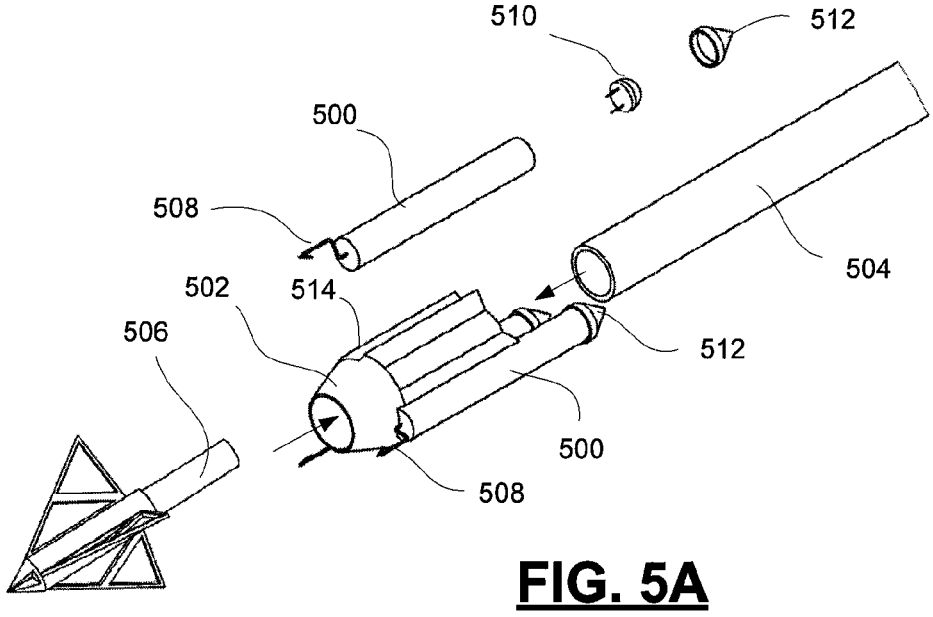
FIGS. 5A and 5B are exploded views of illumination devices according to other embodiments.

As shown in FIG. 5A, there is shown an exploded view of a housing 500 according to one embodiment. Housing 500 includes light source 510, barbed fixture 508 and a power supply (not shown). The housing 500 includes means for releasably attaching the housing 500 to the arrow. In the embodiment of FIG. 5A, the means include a fitting 502. Housing 500 attaches to recess 514 in fitting 502 on the front end of the arrow between the arrow shaft 504 and the arrowhead 506. Housing 500 may be retained with recess 514 by an elastic or frangible retainer. For example, in one embodiment, an elastic band it used to retain housing 500 in recess 514. Housing 500 also includes the circuitry to illuminate the light source 510. The light source 510 is disposed in housing 500. During arrow flight, the user can trace the light source 510. Upon impact with a target, the barbed fixtures 508 attach to the target and separate from the housing 500. The light source 510 remains attached to the housing 500 so that the user can both identify the impact point and, when shooting live game, track the game. In one embodiment, a cap 512 is provided that permits light to pass through the cap. For example, cap 512 may be optically transparent, have slots that light can pass through, or both.

Figure 5B:
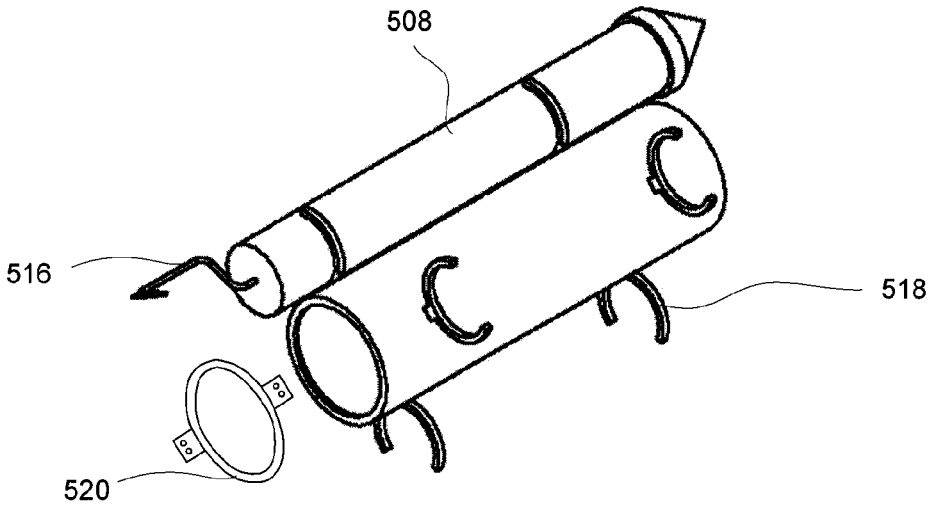

Referring to FIG. 5B, a means for releasably attaching the housing 500 to the arrow is shown. In the embodiment of FIG. 5A, the means include a fitting 516. Fitting 516 is similar to fitting 502 except in that fitting 516 includes snap-clips 518 which mate with housing 500. The mating occurs such that, as the arrow passes through the target, clips 518 permit housing 500 to detach from the fitting 516 and thereby attach to the target.

FIG. 5B also depicts an indexing ring 520 that is disposed between housing 516 and an arrowhead (not shown). Upon attachment of the arrowhead, the index ring 520 locks the housing 516 in place. The indexing ring has at least one tab that engages a corresponding structure on the housing 516 to prevent the housing 516 from rotating during use. This also allows the user to position the housing 516 so that the barbed fixtures do not enter the target directly behind the opening created by the arrowhead.

It is understood that while the embodiments illustrated in the figures shown herein depict the use of a certain number of lights and barbed fixtures, any number of lights and barbed fixtures may be used without detracting from the invention. Likewise, any number of housings may be used. For example, the housing may extend behind each of the blades of the arrowhead. For three bladed arrowhead, this would result in three housings. Furthermore, the barbed fixtures may be fixed hooks or retractable hooks that engage during impact with the target.

While the invention has been described with reference to particular embodiments, it will be understood by those skilled in the art that various changes may be made and equivalents may be substituted for elements thereof without departing from the scope of the invention. In addition, many modifications may be made to adapt a particular situation or material to the teachings of the invention without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed is:

1. A housing for use with an arrow to permit tagging of game with a light source, the arrow having an arrowhead and a shaft, the housing comprising:

at least one light source;

at least one barbed fixture facing a frontend of the housing;

means for releasably attaching the housing to a frontend of the arrow such that the light source detaches from the arrow and attaches to a target when the housing impacts the target; and wherein the means for releasably attaching the housing to the arrow is a sliding ring that is sized to traverse the length of the shaft when the housing impacts a target.

2. The housing as recited in claim 1, wherein the housing is disposed between the arrowhead and the shaft.

3. The housing as recited in claim 1, further comprising a plurality housings, each releasably attached to the arrow, each housing having its own light source and its own barbed fixture.

4. A housing for use with an arrow to permit tagging of game with a light source, the arrow having an arrowhead and a shaft, the housing comprising:

at least one light source;

at least one barbed fixture facing a frontend of the housing;

means for releasably attaching the housing to a frontend of the arrow such that the light source detaches from the arrow and attaches to a target when the housing impacts the target; and further comprising an indexing ring disposed between the arrowhead and the housing.

5. An assembly for use with an arrow to permit tagging of game with a light source, the arrow having an arrowhead and a shaft, the assembly comprising:

at least one housing comprising:

at least one light source;

at least one barbed fixture facing a frontend of the housing, the frontend being proximate the arrowhead;

a fitting configured to attach to the arrow proximate the arrowhead, the fitting comprising means for releasably attaching the housing to the fitting such that the light source detaches from the arrow and attaches to a target when the housing impacts the target; and wherein the means for releasably attaching the housing to the fitting is a snap-clip.

6. The assembly as recited in claim 5, the housing further comprising a cap enclosing the light source, wherein the cap permits light to escape the housing.

7. The assembly as recited in claim 5, wherein the assembly comprises a plurality housings, each releasably attached to the fitting, each housing having its own light source and its own barbed fixture.

8. The assembly as recited in claim 5, wherein the fitting is disposed between the arrowhead and the shaft.

* * * * *